United States Patent [19]

Lanoiselee et al.

[11] Patent Number: 4,862,671

[45] Date of Patent: Sep. 5, 1989

[54] MACHINE FOR THERMOFORMING AN IMPREVIOUS FILM INSIDE A CARDBOARD CONTAINER FOR PACKAGING A FOODSTUFF TO BE PRESERVED AND FOR CLOSING THE CONTAINER

[75] Inventors: Roger Lanoiselee, L'Isle-Adam; Philippe Dropsy, Talence; Patrick Roman, Les Peintures, all of France

[73] Assignee: Societe Continentale du Carton Ondule-Socar, Saint Mande, France

[21] Appl. No.: 151,810

[22] Filed: Feb. 3, 1988

[30] Foreign Application Priority Data

Feb. 10, 1987 [FR] France ..... 87 01629

[51] Int. Cl.[4] ..... B65B 5/02; B65B 7/28

[52] U.S. Cl. ..... 53/167; 53/175; 53/559; 53/281; 53/509

[58] Field of Search ..... 53/509, 559, 510, 453, 53/175, 167, 281

[56] References Cited

U.S. PATENT DOCUMENTS

| | | | |
|---|---|---|---|
| 3,377,770 | 4/1968 | Rorer | 53/509 |
| 3,895,475 | 7/1975 | Wolfelsperger | 53/509 |
| 4,685,274 | 8/1987 | Garwood | 53/559 X |

*Primary Examiner*—John Sipos

*Attorney, Agent, or Firm*—Scully, Scott, Murphy & Presser

[57] ABSTRACT

The machine comprises a thermoforming box (116) which receives the container (126) and which is itself fitted into a cutting box (100), a heating die (148) mounted in vertically slideable manner above the said boxes and capable of squeezing a thermoforming film (44) or a closing film on the upper edge of the thermoforming box and of thermoforming the film (44) inside the container.

14 Claims, 3 Drawing Sheets

MACHINE FOR THERMOFORMING AN IMPREVIOUS FILM INSIDE A CARDBOARD CONTAINER FOR PACKAGING A FOODSTUFF TO BE PRESERVED AND FOR CLOSING THE CONTAINER

The present invention relates to a machine for thermoforming an impervious film inside a cardboard container, for packaging a foodstuff to be preserved under a controlled atmosphere and for closing the container.

In order to facilitate transportation and save space, the containers are delivered to the user in the form of flat open blanks. The user must therefore, at the very locations where the foodstuffs to be preserved are packaged, give the blank a shape, thermoform the film lining in the container thus obtained, create a vacuum in the container and possibly reinject a neutral gas intended to retard bacteria proliferation, and weld a closure of thermoplastic material on the peripheral edge of the container.

For the Patent PCT-A-No. 7 900 409, there is known a machine for manufacturing to sealed packaging containers, starting from a corrugated cardboard blank having a base and panels of side walls ending in flaps intended to form the peripheral edge extending towards the outside of the container and a film lining of thermoplastic material. The blank is inserted in a cradle which brings the side panels into position upright on the base and substantially edge to edge, and the film is then heated to its softening limit and deformed by blowing inside the container such that it is applied to the base, to the side walls and to the peripheral edge.

Such a machine can only carry out the shaping of the container and the thermoforming of the thermoplastic film. To carry out the vacuum reinjection of gas and the closing of the container, one must use another machine. The use of two different machines to carry out a complete cycle of packaging a foodstuff represents a substantial investment which generally exceeds the financial means of small packaging companies. Moreover, these machines occupy a large area on the ground and also require maintenance.

Of course, U.S. Pat. No. 3,377,770 describes a machine which by itself carries out all the operations described above, but the thermoforming of the film is performed directly around the foodstuff to be packaged, without using a cardboard container.

The present invention aims at remedying the disadvantages of the known machines and, to this end, in fact at providing a machine which enables the performing, without modification of its internal structure, of the functions of thermoforming and closure successively.

The machine according to the invention comprises the following:

a slide in the form of a frame of vertical axis, capable of being displaced horizontally, by driving means, between a retracted position and a position inserted in the machine, a lower plate carrying a support frame which has the same section as the slide and on which the latter is capable of bearing in sealed contact when it is in the said inserted position, a fixed upper plate connected to the lower plate by pillars, an intermediate plate guided in vertical movement on the pillars, and normally pushed upwards by first spring means and downwards by a first pneumatic driving means, a cutting box fitted inside the slide and provided on its upper edge with a peripheral blade, a thermoforming box housed inside the cutting box and held above the latter, by second spring means, such that its upper edge is substantially at the same height as the edge of the peripheral blade of the said box, the thermoforming box receiving a carton to be thermoformed or an already thermoformed container containing a food product, and which it is desired to close, the side walls of the cardboard blank or of the container coming level with the upper edge of the thermoforming box, a second driving means intended to push upwards the cutting box and, by means of the second spring means, the thermoforming box, a supply roll of impervious thermoforming film, a supply roll of closing film, one or the other of the said film [sic] being held taut above the slide, a heating die which is in the form of a plate fixed on the lower face of the intermediate plate and which has the same surface area as the outer surface of the slide, such that it comes to squeeze the film against the upper edge of the slide, when the intermediate plate is pushed downwards by the first pneumatic drying means, a first orifice for admission of air or gas being provided in the enclosure formed below the thermoforming film by the slide, the support frame and the lower plate, pressing the thermoforming film flat against the lower face of the die, and a second orifice for the admission of air or gas being provided for blowing hot air in towards the thermoforming film, by way of a plurality of holes pierced in the die, and a peripheral weld element framing the die and intended to weld the closing film against the peripheral lip formed by the thermoforming film outside the container.

The slide is provided, on two opposite side walls, with tabs, as a result of which the slide rests on a carriage mounted horizontally sliding on two laterally arranged guide rods along the said opposite walls of the slide, the movement of the carriage being driven by means of a double-acting jack.

Preferably, the tabs rest on the carriage by means of compressible stops, for example of rubber.

The height of the lower plate can be regulated by means of nuts screwed on threads formed on the lower portions of the pillars, the said nuts being provided with flanges on which rest the corners of the lower plate. It is thus possible to vary at will the distance between the upper plate and the lower plate as a function of the height of the container and of the corresponding equipment mounted on the machine, while maintaining the upper edge of the container at a constant level.

The movement of the nuts is made synchronous by a connection element composed, for example, of a synchronous belt wound around toothed portions formed on the nuts and driven by any known driving means.

The first pneumatic driving means is composed of a bellows jack supplied with compressed air, inserted between the upper plate and the intermediate plate. Similarly, the second pneumatic driving means is composed of a bellows jack supplied with compressed air and inserted between the lower plate and a mobile plate supporting the base of the cutting box and is normally pushed downwards by springs.

The heating die is surmounted by a heating plate which is provided with thermal resistors and in which there are arranged a supply orifice and grooves for blowing air or gas in towards the heating die.

Advantageously, the die has a concave profile on its lower face, for example in the form of a truncated pyramid.

The said second spring means are composed of helical springs which bear against the bases of the thermoforming box and of the cutting box.

The machine according to the invention enables the simultaneous carrying out of the thermoforming inside a shaped cardboard blank and the closing of the container obtained by the thermoforming operation, as will be explained in detail below.

The invention will be better understood by reading the description of one embodiment which follows and which is made with reference to the attached drawings, in which.

Figure 1:
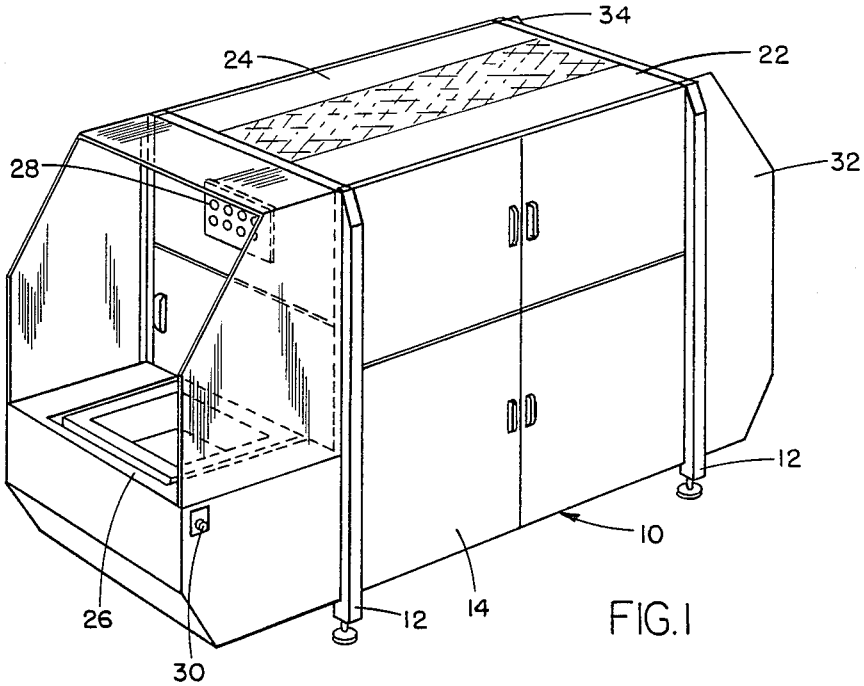
FIG. 1 is a perspective view of the machine as a whole.
Figure 2:
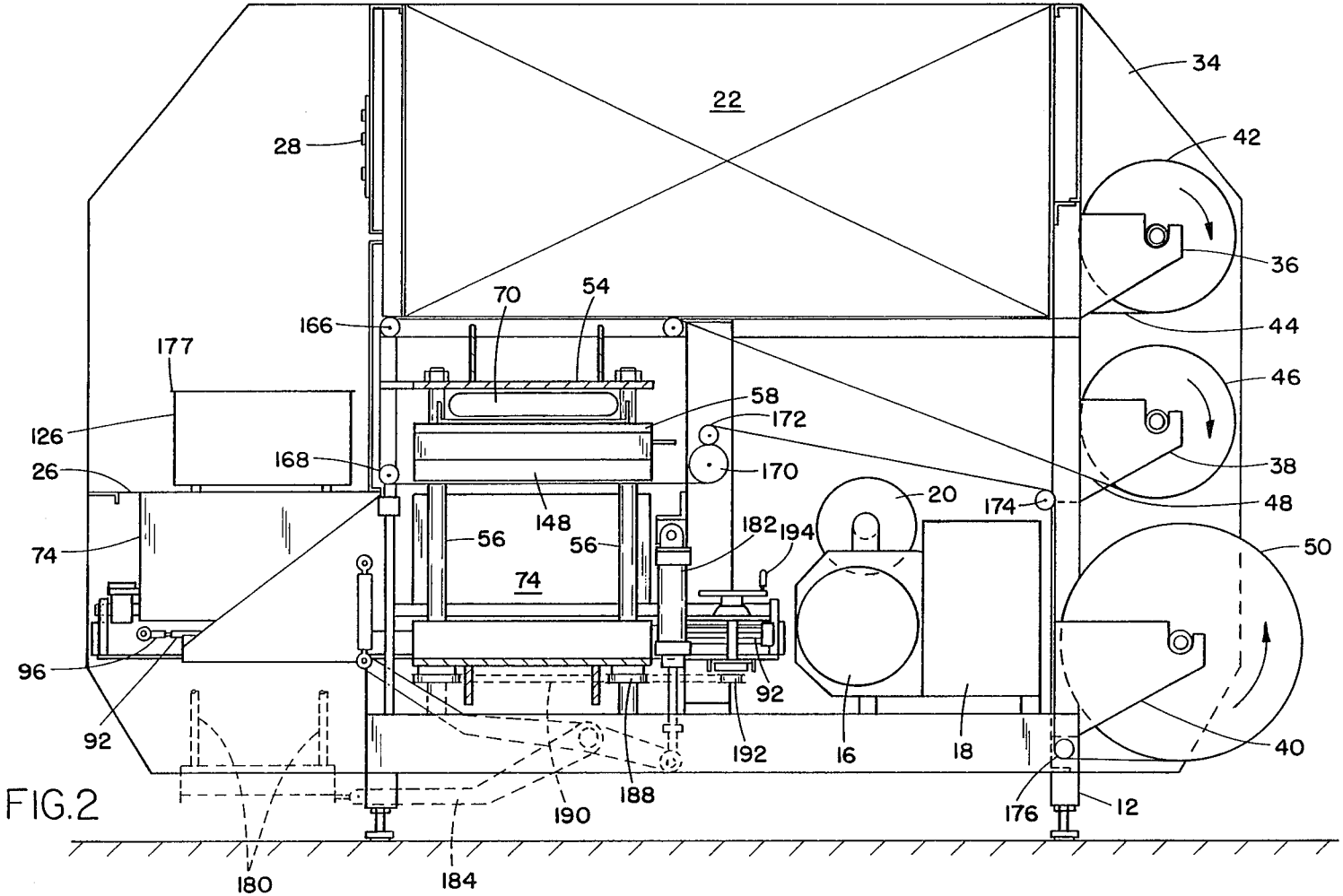
FIG. 2 is a sectional view according to a longitudinal plane of the machine.

Referring first of all to FIGS. 1 and 2, the external form of the machine is a framework 10 which is substantially parallelepipedic and which rests on the ground by four feet 12. It comprises a lower enclosure 14, in which there are enclosed the mechanisms of the machine, and a motor 16, a vacuum pump 18 and an air filter 20. The said enclosure is surmounted on one face by a switch cabinet 22 and on the other face by a pneumatic cabinet 24. These different cabinets are provided with doors for access to the elements they contain.

The machine is extended by a front part forming a work table 26, situated at a height enabling comfortable handling for the operator. Above the work table there are a control desk 28 and, on its side faces, there are provided two buttons 30 side by side, intended to control the translation of the mechanism, as will be explained in detail below. On the side opposite the work surface, the machine is provided with two vertical and parallel plates 32, 34, each carrying three corner plates 36, 38, 40 which are positioned at three different levels. The corner plates are provided with notches intended to receive the ends of the axes of a supply roll 42 of impervious thermoforming film 44, a supply roll 46 of closing film 48 and a roll 50 for rolling up wastage from the said thermoforming film and closing film.

Figure 4:
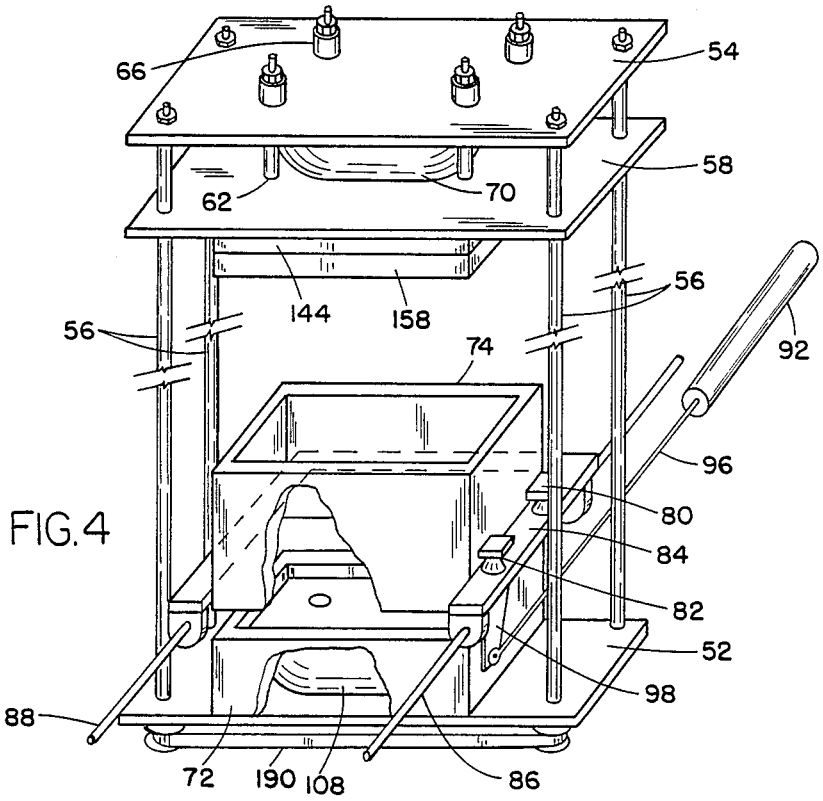
FIG. 4 is a simplified and exploded perspective view showing the principal elements of the machine.
Figure 3:
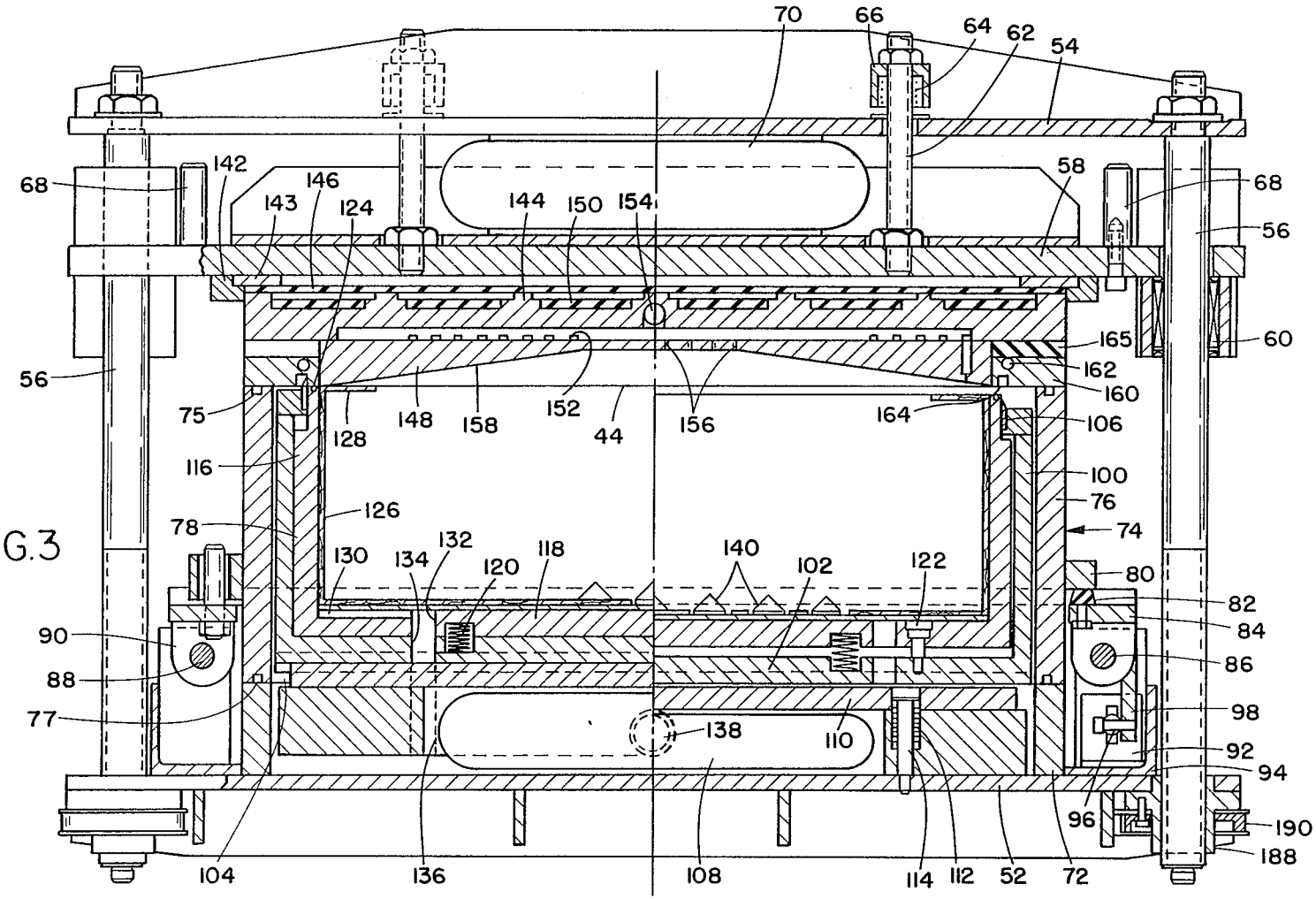
FIG. 3 is a sectional view of the equipment according to a transverse plane of the machine, seen from the position of the operator, the right half of the figure showing the equipment in the low position and the left part showing the equipment in the high position.

Now referring to FIGS. 2 to 4, the machine comprises a lower horizontal plate 52 and an upper horizontal plate 54 braced together by pillars 56, for example four in number, and an intermediate plate 58 guided in sliding movement over the pillars by rolling means 60.

The intermediate plate is connected to the upper plate by several bolts 62 and is normally pushed upwards by springs 64 which bear on the upper face of the intermediate plate and on threaded bushings 66 aimed [sic] at the upper end of the bolts. Upward travel is limited by stops 68. On the other hand, the intermediate plate can be pushed downwards, in opposition to the force of the spring 64, by a pneumatic jack 70 supplied with compressed air, for example of the bellows type. In FIG. 3, the jack is shown in the inflated state, the springs 64 thus being compressed to the maximum.

There is fixed, on the lower plate 52, a frame 72 surmounted by a slide 74 which is also in the form of a frame open at its upper and lower ends and provided on its edges with peripheral sealing joints 75, 77. The frame and slide have exactly the same section which, in the embodiment shown, is rectangular, taking into account the fact that the container to be made is parallelepipedic, but it goes without saying that they can have any other shape of section adapted to that of the container, for example polygonal with at least three sides or even circular.

The slide 74 is provided, on its two opposite side walls 76, 78, which are oriented along the longitudinal axis of the machine, with bearing tabs 80 as a result of which the slide rests, by means of compressible stops 82, for example of rubber, on a carriage 84. The latter slides horizontally along two guide rods 86, 88 arranged horizontally along the said walls 76, 78, rolling means 90 being provided to ensure the smooth movement of the carriage on the rods.

The movement of the carriage is driven by any appropriate driving means, for example by a double-acting jack 92 of which the body is integral with a corner piece 94 and of which the rod 96 (FIGS. 2 and 3) [sic] is connected to a leg 98 which is integral with the carriage.

Inside the slide there is mounted in vertically slidable manner a cutting box 100 of shape complementary to that of the slide, the clearance being such that they almost touch one another. This box is closed by a base 102 which, when it is in the low position, rests on two internal shoulders 104 formed in the lower opening of the slide. It is provided on its upper edge with a peripheral cutting blade 106, of which the edge reaches slightly below the level of the upper edge of the slide when the cutting box is in the low position. It is important to note that, in contrast to the known art, the blade always remains cold and there is no risk of it sticking.

The cutting box can be raised to a high position by the action of a bellows jack 108 which is supplied with compressed air and which acts on the cutting box through a thrust plate 110. The latter is pushed towards its low position by springs 112 threaded around threaded rods 114, one end of which is screwed into the lower plate 52. When the jack 108 is deflated (right-hand side of FIG. 3), the thrust plate 110 is completely inserted inside the frame 72.

Inside the cutting box there is fitted a thermoforming box 116 in the shape of a box, open at its upper end and closed by a base 118 at its lower end. The thermoforming box is pushed upwards by four springs 120 bearing in cavities formed in the bases 102 and 118, and its travel is limited by stops 122. The springs 120 are less strong than the jack 108. As is shown by the right-hand half of FIG. 3, the upper edge of the thermoforming box normally reaches slightly above the cutting blade 106. The said upper edge is provided with a peripheral weld joint 124.

There is inserted in the thermoforming box a cardboard blank 126 or a thermoformed container, depending on whether the inside walls of the blank are to be lined with an impervious film or the container is to be obturated with a closure. In the embodiment illustrated by FIG. 3, the container has a parallelepipedic rectangular shape and is provided on its opening with a horizontal peripheral shoulder 128 extending towards the inside. As is known, such a shoulder enables several containers to be stacked. But it goes without saying that a container having any other shape of section can be thermoformed and closed with the machine according to the invention, for example a square, hexagonal or even circular container, and one provided or otherwise with a peripheral shoulder.

As is shown in FIG. 3, on the base 118 of the thermoforming box there are machined channels 130 ending in coinciding orifices 132, 134, 136 which are respectively pierced through the bases 102 and 118 of the cutting box and the thermoforming box and through the plate 102. These channels and orifices allow the internal volume of the container to communicate, through the joints of the vertical sides of the container, with a lower orifice 138 which can be connected either to the atmosphere or to a source of compressed air or again to a vacuum source by means of a pneumatic distributor.

Moreover, studs 140 [sic] can be fixed to the base of the thermoforming box. These studs have the function, while passing through orifices pierced in the base of the container, of serving as a jig for the thermoforming of protuberances intended to keep the product to be packaged suspended above the base of the container.

There are fixed on the intermediate plate 58 two horizontal guide slide rails 142 oriented parallel to the longitudinal axis of the machine. On the said slide rail there is suspended in slidable manner a heating assembly comprising a suspension frame 143, a heating plate 144 fixed to the suspension frame and with an insulating plate 146 positioned between them, and a heating die 148 fixed to the heating plate.

In the latter there are inserted electrical resistors 150 and there is milled a network of blowing grooves 152 through which the air arriving through a supply orifice 154 and heated by the resistors 150 is blown in through a plurality of holes 156 pierced through the heating die.

The latter is substantially in the form of a plate which has the same surface area as the internal surface of the thermoforming box 116, and it has on its lower face a concave profile 158, for example in the form of a truncated pyramid of rectangular base.

The die is surrounded by a weld frame 160, of which the width of its base section is equal to the sum of the thicknesses of the walls of the slide 74, of the cutting box 100 and of the thermoforming box 116, such that, in the low position of the intermediate plate 58, the said weld frame squeezes the thermoforming film 44 onto the upper layers of the slide and of the thermoforming box. There are inserted in the weld frame a peripheral electrical resistor 162 and, on its lower face, a peripheral groove 164 into which the cutting blade 106 is capable of penetrating. The weld frame is separated from the heating plate by an insulating frame 165.

There will now be described the operation of the machine when it is used for thermoforming: the electrical resistors 150 are made live and the bellows jack 70 is connected to the open air, which has the effect that the upper plate 54 and the heating assembly 144, 148 which is integral with it are brought by the springs 64 into the high position, emitted by contact of the stops 68 with the upper plate. The slide 74 is then released and the elastic stops 82 are thus relaxed, slightly lifting the slide above the frame 72. The jack 92 can then cause the slide and the boxes 100 and 116 which it contains to slide into the extended position, where they are positioned in the working plane 26, as shown in FIG. 1 and by a solid line in FIG. 2.

The operator introduces into the thermoforming box 116 a cardboard blank 126 in the preformed position, while an external device (not shown) pays out the thermoforming film 44 from the roll 42 (see FIG. 2). The film passes successively over rollers 166, 168, 170, 172, 174 and 176, to be rolled onto the wastage roll 50. The portion of film between the rollers 168 and 170 is held taut below the die 148.

By pressing the buttons 30 (FIG. 1), the operator then controls the inverse translation of the slide 74, which thus is moved back into place below the die 148. The bellows jack 70 is then put under pressure such that the thermoforming film 44 is squeezed between the weld frame 160 and the slide. The vertical force exerted by squeezing the film compresses the elastic stops 82, thus ensuring sealing between the slides 74 and the lower frame 72. The result is that the enclosure defined by the heating plate 144, slide 74, the frame 72 and the lower plate 52 is hermetically sealed.

The upper orifice 154 is then exposed to the open air, and air at low pressure, of the order of 0.5 bar, is injected through the lower orifice 138 and penetrates into the sealed enclosure defined above, pressing the thermoforming film 44 flat against the concave face 158 of the heating die, the time required for obtaining softening being compatible with the thermoforming. Thus, in contrast to the machines of the prior art, the film is blown towards the concave face 158 and not sucked. The risk of closing the orifices 156 of the die is thus considerably diminished.

As soon as the desired temperature has been reached, air under high pressure, of the order of 4 to 5 bars, is blown into the bellows jack 108. The inflation of the latter pushes the mobile plate 110 upwards, thus lifting the cutting box 100 and the thermoforming box 116 by means of the springs 120. The thermoforming box squeezes the film 44 against the weld frame 160, while the cutting box 116 continues to rise, compressing the springs 120.

The cutting blades 106 penetrate into the groove 164 and cut the film, allowing a peripheral lip 177 to protrude outside the container (FIG. 2). The total pressure of the jack 108 is thus exerted to squeeze the film between the thermoforming box 116 and the weld frame 160.

At this point, the upper orifice 154 is switched to the source of compressed air and the lower orifice 138 is exposed to the open air. The compressed air, which passes through the holes 156 pierced through the die, pushes away the film which is against the inside walls of the container 126. The air situated below the film escapes through the joints of the container and the channels 130, towards the orifices 132, 134, 136 and 138. When the pressure displayed for thermoforming is reached, a pressure-sensitive switch switches off the admission of the compressed air into 154.

A time delay maintains this pressure for the time necessary for cooling and stabilization of the thermoformed film.

Once this time has elapsed, the jack 108 is connected to the open air. The boxes 100 and 116 descend, and the air under elevated pressure contained in the thermoformed package escapes via the upper periphery of the box 116 towards the orifice 138, passing into the space arranged between the boxes 74 and 100.

The admission of air is then interrupted in the bellows jack 70, which is connected to the open air.

The intermediate plate 58 rises again to the high position under the action of the springs 64, until the stops 68 come into contact with the upper plate. Once the carriage 84 has been released, the slide can be ejected from the machine towards the work table 26 (FIG. 1). In this position, vertical ejectors 180 (FIG. 2) actuated by a jack 182 by means of a lever 184 penetrate through the orifices 136, 134, 132 to eject the container 126 from the thermoforming box. The cycle is thus complete.

There will now be described the operation of the machine in closing mode. The thermoforming film is wound back and is replaced by the closing film 48, which is made to pass along the same route. Only the resistor 162 is live. Once the mobile carriage 84 has been ejected from the machine, the operator introduces into the thermoforming box 116 a container 126 containing the foodstuff to be packaged. By pressing the two buttons 30 which are side by side, he controls the conveyance of the carriage inside the machine, by the action of the jack 92. The arrival of the carriage into the centre of the machine controls the admission of compressed air in the bellows jack 70, which then causes the intermediate plate 58 to descend. The closing film 48 is thereby squeezed between the slide 74 and the weld frame 160.

The pressure exerted by the jack 70 pushes the slide 74 downwards, and this compresses the elastic stops 82. The slide comes up against the lower frame 72, and the sealed enclosure is thereby closed.

A vacuum is established in orifices 138 and 154, so that the former are balanced on the lower and upper faces of the closing film. A vacuum is also established in the bellows jack 108. When the desired level of vacuum is reached, the vacuum is interrupted at orifices 138 and 154, and the latter are switched to the supply circuit of reinjection gas. When the pressure of this gas is the same as atmospheric pressure, the admission of the gas is stopped at orifices 138 and 154. From this moment, compressed air is admitted to the bellows jack 108. The plate 110 rises, its movement driving the cutting box 100. The latter, by means of the springs 120, in turn raises the box 116, which comes to press the closing film flat against the weld frame 160 on the peripheral lip 177 obtained during thermoforming. The force exerted by the jack 108 then compresses the springs 120 until the moment when the bases 102 and 118 of the boxes 100 and 116 come into contact. By rising, the cutting blades 106 cut the closing film.

The total force of the bellows jack 108 is then available for pressing flat the closing film hard against the peripheral lip of the container. The calories emitted by the weld frame 160 ensure that the closing film is welded.

The admission of compressed air is then interrupted at the bellows jacks 70 and 108, which are connected to the open air. The intermediate plate 58 rises again, and the plate 110 descends again. The stops 82 relax, separating the slide 74 from the lower frame 72, and finally the jack 92 again brings the carriage and the slide outside the machine, where the closed container is ejected as before.

Various modifications can be applied to the machine according to the invention. Thus, it is possible that the height of the lower plate 52 can be regulated such that containers of different heights could be processed without otherwise modifying the machine. To this end, the lower plate is supported at its four corners by nuts 188 (FIGS. 2 and 3) screwed onto the pillars 56. The movement of these nuts is made synchronous by a synchronous belt 190 wound on the nuts and on a driving pinion 192 driven by a crank 194, or by any other appropriate driving means.

On the other hand, the machine can be used for the simultaneous processing of several containers at once, for example two or four, which can be inserted inside the slide 74. For this, the cutting box 100 and the thermoforming box 116, as well as the die 148, are dissembled and replaced by other boxes and dies smaller in size and equipped to allow the squeezing and cutting of the thermoforming or closing films along the periphery of all the containers in place in the thermoforming box at the same time.

We claim:

1. A machine for thermoforming an impervious film inside a cardboard container for packaging a foodstuff and for closing the container, which comprises:

a slide (74) in the form of a frame of vertical axis, capable of being displaced horizontally, by driving means (92), between a retracted position and a position inserted in the machine, a lower plate (52) carrying a support frame (72) which has the same section as the slide and on which the latter is capable of bearing in sealed contact when it is in the position inserted in the machine;

a fixed upper plate (54) connected to the lower plate by pillars (56);

an intermediate plate (58) guided in vertical movement on the pillars, and normally pushed upwards by first spring means (64) and downwards by a first pneumatic driving means (70);

a cutting box (100) fitted inside the slide and provided on its upper edge with a peripheral blade (106);

a thermoforming box (116) housed inside the cutting box and held above the latter, by second spring means (120), such that its upper edge is substantially at the same height as the edge of the peripheral blade (106) of the said box, the thermoforming box receiving a carton (126) to be thermoformed or an already thermoformed container containing a food product, and which it is desired to close, the side walls of the cardboard blank or of the container coming level with the upper edge of the thermoforming box;

a second pneumatic driving means (108) intended to push upwards the cutting box (100) and, by means of the second spring means (120), the thermoforming box (116);

a supply roll (42) of impervious thermoforming film (44);

a supply roll (46) of closing film (48), one or the other of the said films being held taut above the slide, and a heating die (148) which is in the form of a plate fixed on the lower face of the intermediate plate (58) and which has the same surface area as the outer surface of the slide, such that it comes to squeeze the film (44 or 48) against the upper edge of the slide, when the intermediate plate is pushed downwards by the first pneumatic driving means (70), a first orifice (138) for admission of air or gas being provided in the enclosure formed below the thermoforming film by the slide, the support frame and the lower plate, pressing the thermoforming film flat against the lower face of the die, and a second orifice (154) for the admission of air or gas being provided for blowing hot air in towards the thermoforming film, by way of a plurality of holes (156) pierced in the die, and a peripheral weld element (160) framing the die (148) and intended to weld the closing film against the peripheral lip (177) formed by the thermoforming film outside the container.

2. A machine as claimed in claim 1, wherein the slide is provided, on two opposite side walls, with tabs (80), as a result of which the slide rests on a carriage (84) mounted horizontally sliding on two laterally arranged guide rods (86, 88) along the said opposite walls of the slide, the movement of the carriage being driven by means of a double-acting jack (92).

3. A machine as claimed in claim 2, wherein the tabs rest on the carriage by means of compressible stops (82), for example of rubber.

4. A machine as claimed in claim 1, wherein the height of the lower plate (52) can be regulated by means of nuts (188) screwed on threads formed on the lower portions o the pillars (56), the said nuts being provided with flanges on which rest the corners of the lower plate.

5. A machine as claimed in claim 4, wherein the movement of the nuts is made synchronous by a connection element composed, for example, of a synchronous belt (190) wound around toothed portions formed on the nuts and driven by any known driving means (194).

6. A machine as claimed in claim 1, wherein the first pneumatic driving means is composed of a bellows jack (70) supplied with compressed air, inserted between the upper plate (54) and the intermediate plate (58).

7. A machine as claimed in claim 1, wherein the second pneumatic driving means is composed of a bellows jack (108) supplied with compressed air and inserted between the lower plate (52) and a mobile plate (110) supporting the base of the cutting box (100), this jack normally being pushed downwards by springs (112).

8. A machine as claimed in claim 1, wherein the heating die (148) is surmounted by a heating plate (144) which is provided with thermal resistors (150) and in which there are arranged a supply orifice (154) and grooves (152) for blowing air or gas in towards the heating die.

9. A machine as claimed in claim 1, wherein the die has a concave profile (158) on its lower face, for example in the form of a truncated pyramid.

10. A machine as claimed in claim 1, wherein the weld element (160) is composed of a frame which laterally surrounds the die and in which there is inserted a heating resistor (162), the said frame having a width which is equal in section to the sum of the thicknesses of the walls of the slide, of the cutting box and of the thermoforming box.

11. A machine as claimed in claim 10, wherein the weld frame (160) is provided with a groove (64) into which the cutting blade (106) is capable of penetrating.

12. A machine as claimed in claim 1, wherein the die is heated by a heating plate (144) situated above it and insulated from the intermediate plate (58) by an insulating plate (146).

13. A machine as claimed in claim 12, wherein the die (148), the heating plate (144) and the insulating plate (146) for an integrally formed assembly slideably mounted on slide rails (142) fixed below the intermediate plate (58).

14. A machine as claimed in claim 1, wherein the said second spring means (120) are composed of helical springs which bear against the bases of the thermoforming box and of the cutting box.

* * * * *

UNITED STATES PATENT AND TRADEMARK OFFICE

CERTIFICATE OF CORRECTION

PATENT NO. : 4,862,671

DATED : September 5, 1989

INVENTOR(S) : Roger Lanoiselee, et al.

It is certified that error appears in the above-identified patent and that said Letters Patent is hereby corrected as shown below:

On the Title page, under Item [54]: "IMPREVIOUS" should read as --IMPERVIOUS--

Column 1, line 3: "IMPREVIOUS" should read as __IMPERVIOUS--

Column 9, line 21: "o" should read as --of--

Column 10, line 21; "(64)" should read as --(164)--

Signed and Sealed this

Sixth Day of November, 1990

*Attest:*

HARRY F. MANBECK, JR.

*Attesting Officer*

*Commissioner of Patents and Trademarks*